US005539166A

United States Patent [19]

Reier

[11] Patent Number: 5,539,166

[45] Date of Patent: Jul. 23, 1996

[54] PNEUMATIC-ELECTRICAL CONTROL DEVICE

[75] Inventor: Gerald J. Reier, Arlington, Tex.

[73] Assignee: BHM Company, Fort Worth, Tex.

[21] Appl. No.: 348,303

[22] Filed: Dec. 2, 1994

[51] Int. Cl.[6] ..... H01H 35/26; B02C 23/00

[52] U.S. Cl. ..... 200/81 H; 200/81 R; 241/32.5

[58] Field of Search ..... 200/52 R, 81 R, 200/81 H, 82 R; 241/46.01–46.016, 31–45; 4/619

[56] References Cited

U.S. PATENT DOCUMENTS

| | | | |
|---|---|---|---|
| 3,571,821 | 3/1971 | Kaiser | 4/619 |
| 3,902,028 | 8/1975 | Tremain | 200/81 R |
| 4,124,789 | 11/1978 | Preece | 200/81 R |
| 4,150,264 | 4/1979 | Lieberman | 200/51 LM |
| 4,209,678 | 6/1980 | Hussey | 200/81 R |
| 4,647,738 | 3/1987 | Diamond | 200/81 H |
| 4,668,847 | 5/1987 | Greene | 200/82 R |
| 4,754,107 | 6/1988 | Tracey | 200/81 H X |
| 5,118,909 | 6/1992 | Husting | 200/81 H |
| 5,249,749 | 10/1993 | Krebsbach | 241/46.016 |

*Primary Examiner*—J. R. Scott
*Attorney, Agent, or Firm*—Charles D. Gunter, Jr.

[57] ABSTRACT

An electrical kitchen appliance, such as a garbage disposal unit, is operated by providing a pneumatically actuated switch which prevents the user from being shocked due to the presence of water in the area. The pneumatic switch can be moved between an on and an off position so that electrical current is supplied or cut off from the appliance. A non-electrically conductive air conduit is connected to the switch and leads to a remote location from the appliance. A bellows is supplied at the remote location and forces air through the conduit to the pneumatic switch, switching the appliance on or off. Because the bellows is not electrically connected to the switch and is located at remote distance, electrical shock due to the presence of water is eliminated.

4 Claims, 1 Drawing Sheet

PNEUMATIC-ELECTRICAL CONTROL DEVICE

BACKGROUND OF THE INVENTION

1. Field of the Invention

This invention relates to a method of switching an electrical appliance on and off in an area where there is a risk of electrical shock due to the presence of water associated with the area.

2. Description of the Prior Art

Prior art methods of operating kitchen appliances which are permanently mounted as a fixture of a room or dwelling, such as a garbage disposal, include providing the appliance with an electrical switch for switching the appliance on and off.

The electrical switch is operated by means of a person grasping and moving a protruding toggle or knob portion of the switch which protrudes above the switch wall plate so that an electrical connection of the circuit powering the appliance is made or broken as a direct result of the person moving the switch between an on and off position. The live electrical wires which supply power to the appliance are usually no more than about an inch from that portion of the switch which the user grasps or touches. This presents an electrical hazard when the switch is located adjacent to wet areas, such as the sink, where the switch may be splashed with water, or where the user is likely to have wet hands.

Because contacting the switch with water presents an electrical hazard, it was not easily or safely possible to wipe down a dirty or soiled switch with a wet cloth or other cleaning implement.

A need exists, therefore, for an improved apparatus and method for switching an electrical kitchen appliance on and off where there is a risk of electrical shock due to the presence of water in the surrounding environment.

A need also exists for such an apparatus which is simple in design and economical to manufacture, preferably using commercially available parts.

A need also exists for such an apparatus which can be easily installed within the existing electrical circuitry of a conventional kitchen, without requiring customization of the existing kitchen appliance being retrofitted, or the existing kitchen electrical switch.

A need also exists for such a switching apparatus which can be easily cleaned with water, whether wall or countertop mounted, without fear of electrical shock.

A need exists for a method and apparatus as previously described which can be purchased and installed inexpensively and which is esthetically appealing in the home or kitchen environment.

SUMMARY OF THE INVENTION

The present invention provides a method of switching an electrical kitchen appliance on or off in an area where there is a risk of electrical shock due to the presence of water associated with the area. The method is accomplished by installing a pneumatically actuated switch within the existing electrical circuit which powers the kitchen appliance. The pneumatically actuated switch is moveable between an on and an off position. In the on position, electrical current is supplied to the kitchen appliance, thereby supplying power to the appliance. When the pneumatically actuated switch is moved to the off position, electrical current is cut off from the appliance. A non-electrically conductive air conduit is connected to the pneumatically actuated switch and leads from the switch to a location which is remote from the appliance. Air is directed from the remote location, through the conduit and to the switch, so that the switch is moved to a selected one of the on and off positions. In a preferred embodiment of the invention, air is directed from the remote location by compressing a hand operated bellows type device.

Additional objects, features and advantages will be apparent in the written description which follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
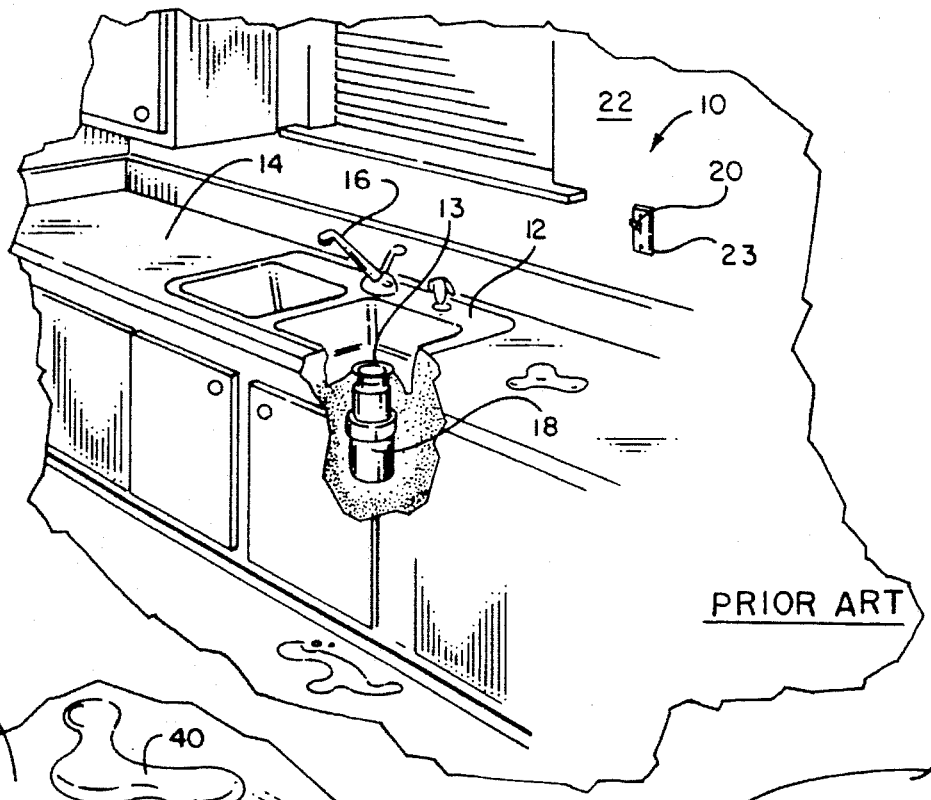
FIG. 1 shows a prior art kitchen having a garbage disposal unit with a conventional wall mounted electrical switch used to operate the garbage disposal unit.

FIG. 1 shows a typical prior art kitchen environment 10 which is provided with a sink 12 mounted within a counter space 14. The sink 12 is provided with a faucet 16 of conventional design connected to a conventional water supply (not shown), the sink also being provided with a drain 13 for draining the contents of the sink 12. A garbage disposal unit 18 is mounted to the sink 12 for grinding waste material that is passed out of the sink 12 through the drain 13. The garbage disposal unit 18 is operated by means of a conventional single pole, single throw electrical switch 20 mounted within a wall box of the kitchen vertical wall 22. The switch internal components which are housed within the wall box are covered by a wall plate 23.

Figure 2:
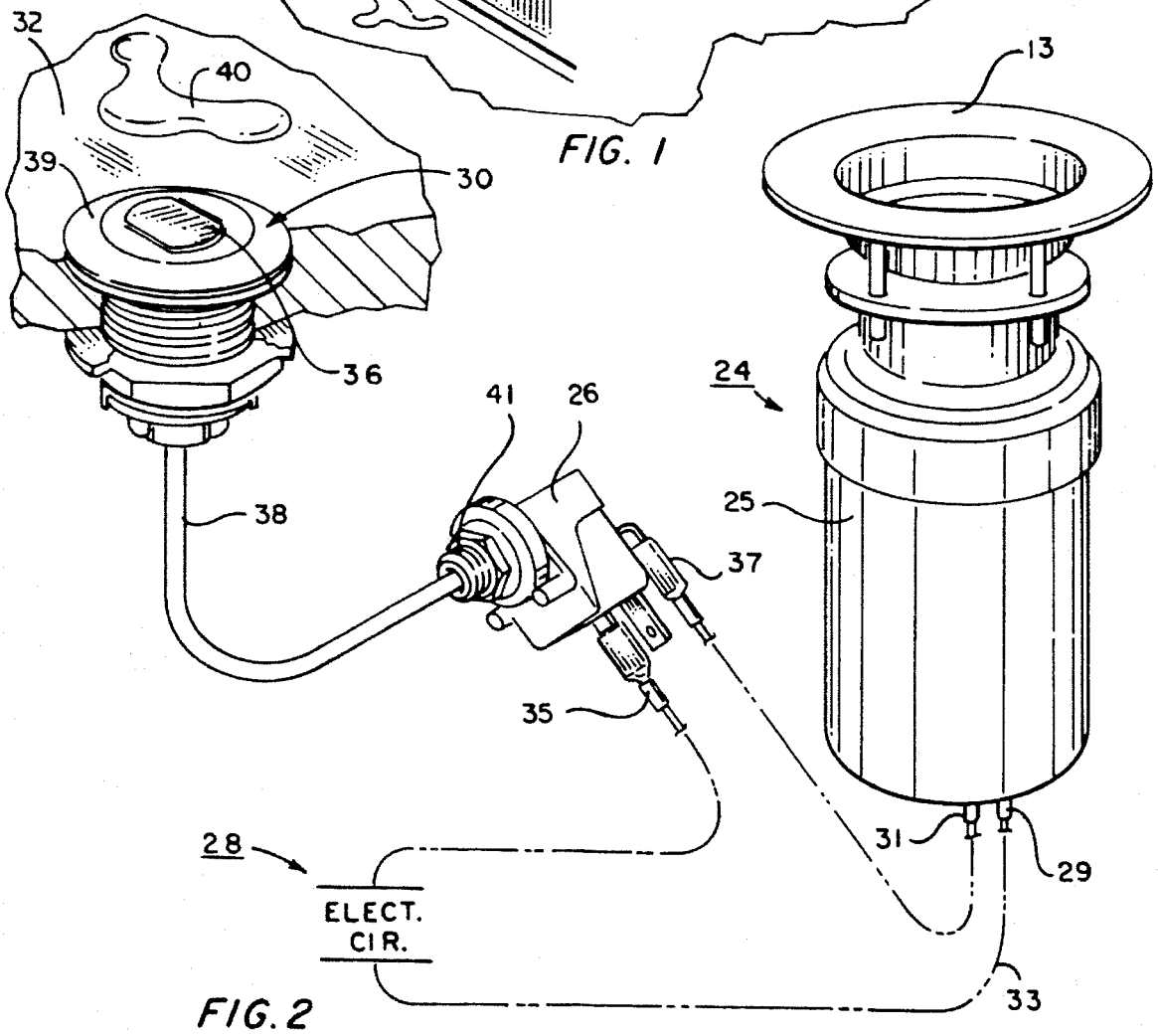
FIG. 2 is an isolated view, partially schematic, of the pneumatically operated garbage disposal unit which is constructed in accordance with the method of the invention.

Referring to FIG. 2, a garbage disposal unit 24 is shown and constructed similarly to the garbage disposal unit 18, shown in the prior art of FIG. 1. The garbage disposal unit 24 includes an electric motor contained within a cylindrical housing 25 which powers a blade or impact mechanism (not shown) for grinding the waste material entering the drain. Such garbage disposal units are available from any number of commercial sources.

The garbage disposal unit 24 is powered by means of the house or dwelling electrical circuit, illustrated schematically as 28 in FIG. 2. In the embodiment of FIG. 2, a pair of electrical leads 29, 31 are connected by means of suitable wiring 33 within the house electrical circuit 28. A pneumatic control means, in this case a two position pneumatic switch 26, is also located in the electrical circuit 28 and replaces the conventional electrical switch, shown as 20 in FIG. 1. Alternatively, the pneumatic switch 26 can be installed within the electrical circuit 28 which also contains the conventional electrical switch (20 in FIG. 1). The conventional switch 20 then becomes a fail safe switch for the circuit. That is, it can be left on continually with the pneumatic switch 26 being used to control the disposal 24, or can be switched to the off position to disable the circuit.

Pneumatic switches are known in the art and are commercially available. An example of such a switch is disclosed in U.S. Pat. No. 4,150,264, the disclosure of which is hereby incorporated herein by reference. A commercially available switch such as that shown in FIG. 2 is available from Pres:Air:Trol Corp. of Mamoroneck, N.Y. as the TVA IIA. The switch 26 electrical contacts 35, 37 which are connected by wiring 33 within the electrical circuit 28.

A bellows 30 is mounted to a support structure 32 at a position in the vicinity of the switch 26, usually a few feet away. The support structure 32 can be a counter top or a wall, such as the counter 14 and wall 22 of FIG. 1. The bellows 30 is preferably mounted in an area located adjacent to the garbage disposal unit 24 so that the user does not have to step away from the sink or area where the garbage disposal unit 24 is located. The upper surface or flange 39 of the bellows 30 is substantially flush with the surrounding exposed surface of the support structure 32 so that it remains unobtrusive.

The bellows 30 is preferably made of a non-electrically conductive material, such as plastic. The bellows 30 is constructed with a housing 34 which depends from the mounting flange 39 which mounts to the support structure 32. The housing 34 holds a depressible plunger 36 which acts upon a compressible gas reservoir (not shown) of the bellows 30 when the plunger is moved between an up and a down position. The preferred gas is atmospheric air. The air reservoir may be a collapsible rubber bulb or other air tight chamber located within the housing 34. The plunger 36 is biased so that it returns to the original, up position after being depressed to the down position. This also allows the air reservoir to fill with air after it has been compressed or collapsed. A bellows of the type shown in FIG. 2 is commercially available from the Pres:Air:Trol Corp. of Mamaroneck, N.Y., as the "Pres:Air:Trol."

Joined to the air reservoir of the bellows 30 is an air conduit 38. The air conduit 38 leads from the bellows 30 to the pneumatic switch 26 where it is joined thereto at a fitting 41. The conduit 38 is made of an electrically non-conductive material so that current cannot be conducted from the switch 26 to the bellows 30.

The operation of the improved pneumatic-electric control device will now be described. By depressing the plunger 36, the air reservoir (not shown) of the bellows 30 is compressed so that air is forced out of the bellows 30, through the conduit 38 and to the pneumatic switch 26 to move the switch between on and off positions. For example, if the switch is initially off, depressing the bellows 30 causes the pneumatic switch 26 to complete the electrical circuit of the wiring 28 so that electrical current flows to the garbage disposal 24. The garbage disposal 24 is thus supplied with power and commences operation.

To turn off the garbage disposal unit 24, the user then merely depresses the plunger 36 again so the air reservoir of the bellows 30 is collapsed and air is forced through the conduit 38 to the pneumatic switch 26, moving the pneumatic switch 26 to the opposite, off position, to break the electrical circuit formed by the wiring 28. Electrical current is thus prevented from flowing to the garbage disposal unit 24 so that it is deactivated.

An invention has been provided with several advantages. Because the bellows is not electrically connected to the switch and is located at a remote distance from the electrical wiring, there is no chance for a user to be shocked from switching the garbage disposal on or off. If water is spilled or splashed on the bellows, or if the user has wet hands, the user can still safely turn the appliance on or off. The switch, whether wall or counter mounted, can be safely cleaned with soap and water. The system can be easily installed with little or no modification to the existing kitchen layout.

While the invention is being shown in only one of its embodiments, it should be apparent to those skilled in the art that it is not so limited but is susceptible to various changes without departing from the scope of the invention.

I claim:

1. A method of switching an electrical kitchen appliance on and off in a first planar location where there is a risk of electrical shock due to the presence of water associated with the area, the kitchen appliance being powered by an electrical circuit the method comprising:

installing a pneumatically actuated switch within the electrical circuit of the kitchen appliance, the pneumatically actuated switch being movable between an on position, where electrical current is supplied to the kitchen appliance thereby powering the kitchen appliance, and an off position, where electrical current is cut off from the appliance;

providing a nonelectrically conductive air conduit connected to the pneumatically actuated switch which leads from the switch to a remote location from the kitchen appliance;

directing air from the remote location through the conduit to the switch so that the switch is switched to one of the on and off positions;

wherein air is directed from the remote location through the conduit by compressing a bellows which is connected to the air conduit at the remote location, whereby compressing the bellows forces air through the conduit to the switch; and where the bellows is mounted to an adjacent planar surface which is parallel to the first planar location.

2. A method of switching a garbage disposal mounted to a countertop in a first planar location on and off in an area where there is a risk of electrical shock due to the presence of water associated with the area, the garbage disposal being powered by an electrical circuit the method comprising:

installing a pneumatically actuated switch within the electrical circuit of the garbage disposal, the pneumatically actuated switch being movable between an on position, where electrical current is supplied to the garbage disposal thereby powering the garbage disposal, and an off position, where electrical current is cut off from the garbage disposal;

providing a nonelectrically conductive air conduit connected to the pneumatically actuated switch which leads from the switch to a remote location from the garbage disposal;

providing a hand operated bellows at the remote location which is connected to the conduit;

directing air from the remote location through the conduit to the switch by compressing the hand operated bellows so that air is forced through the conduit to the switch, the switch being switched to one of the on and off positions; and wherein the bellows is mounted to an adjacent planar surface which is parallel to the first planar location.

3. The method of claim 2, wherein:

the bellows is mounted to a counter top of the kitchen.

4. A method of switching an electrical garbage disposal unit on and off, the garbage disposal unit being mounted to a sink and having a mouth opening in a first planar location, the garbage disposal being powered by an electrical circuit including an electrical on/off switch, the method comprising:

installing a pneumatically actuated switch within the electrical circuit of the garbage disposal unit, the pneumatically actuated switch being movable between an on position, where electrical current is supplied to the garbage disposal thereby powering the disposal unit, and an off position, where electrical current is cut off from the disposal unit;

providing a nonelectrically conductive air conduit connected to the pneumatically actuated switch which leads from the switch to a remote location from the garbage disposal unit;

providing a bellows at the remote location which is connected to the conduit;

compressing the bellows so that air is forced through the conduit to the switch, wherein the switch is switched to one of the on and off positions;

leaving the electrical on/off switch in the electrical circuit in the on position, whereby moving the electrical on/off switch to the off position serves as a fail safe mechanism to disable the electrical circuit; and wherein the bellows is mounted to a countertop located adjacent to the garbage disposal unit in an adjacent area parallel to the first planar location.

* * * * *